US005388362A

United States Patent [19]

Melcher

[11] Patent Number: 5,388,362

[45] Date of Patent: Feb. 14, 1995

[54] MAGAZINE SAFETY FOR A MAKAROV PISTOL

[75] Inventor: Roy L. Melcher, Alexandria, Va.

[73] Assignee: International Armament Corporation, Alexandria, Va.

[21] Appl. No.: 151,285

[22] Filed: Nov. 12, 1993

[51] Int. Cl.[6] ..... F41A 17/36

[52] U.S. Cl. ..... 42/70.02; 42/70.04

[58] Field of Search ..... 42/70.02, 70.04, 70.05, 42/70.06

[56] References Cited

U.S. PATENT DOCUMENTS

| | | | |
|---|---|---|---|
| 1,024,932 | 4/1912 | Vander Haegben | 42/70.02 |
| 1,719,384 | 7/1929 | Tansley | 42/70.02 |
| 3,415,000 | 12/1968 | Koucky et al. | 42/70.02 |
| 3,715,826 | 2/1973 | Seifried | 42/70.02 |
| 3,857,325 | 12/1974 | Thomas | 42/70.02 |
| 4,031,648 | 6/1977 | Thomas | 42/70.02 |
| 4,428,138 | 1/1984 | Seecamp | 42/70.02 |
| 5,225,612 | 7/1993 | Bernkrant | 42/70.02 |

*Primary Examiner*—David Brown
*Attorney, Agent, or Firm*—Charles W. McHugh

[57] ABSTRACT

An auxiliary safety device intended for use as a magazine safety with a semi-automatic pistol of the Makarov design, said pistol being a blowback-operated, magazine-fed that is operable in double-action or single-action modes. The pistol's factory-original parts include a sear that pivots with respect to the pistol's frame about an axis that is defined by a transverse support post. The pistol has a sear cam that operates on the hammer in double-action operation, and operates on the sear in single-action operation. The auxiliary safety device includes two parts, the first being a relatively thin structural plate having front and rear portions. A relatively large and generally circular opening is located about midway between the front and rear portions; the opening is large enough to fit around and rotate with respect to the transverse post. The second part is a torsion spring adapted to be mounted on the transverse post for always biasing the plate to a position where it encroaches slightly into the pistol's magazine well. When the magazine has been removed from the well, the structural plate rotates forward (by about 50°); its rear portion then blocks normal movement of the sear cam, thereby precluding firing of the pistol. When a magazine is inserted into the well, the plate is rotated backwardly, and the pistol will operate normally. None of the original Makarov pistol parts require modification in order to accept the auxiliary magazine safety.

17 Claims, 2 Drawing Sheets

MAGAZINE SAFETY FOR A MAKAROV PISTOL

BACKGROUND OF THE INVENTION

This invention relates generally to a safety mechanism for a semi-automatic pistol that is fed from a detachable magazine, said mechanism often being called a magazine safety; more specifically this invention relates to a magazine safety for a particular pistol commonly known as the Makarov pistol.

The term "Makarov pistol" refers to a pistol that was the standard military sidearm of the former Union of Soviet Socialist Republics (USSR), beginning about 1954. It is a relatively compact pistol (having a length of about 16 centimeters) and is a semi-automatic, magazine-fed, blowback pistol that fires a 9×18 millimeter cartridge. The Makarov pistol has also been a standard military sidearm of some countries of the former East Bloc, including the former German Democratic Republic (East Germany) and the People's Republic of China (PRC). The pistol has also been variously known as the PM, Pistolet Makarova, Pistole M, Type 59 and other designations, depending on the country of manufacture or use; it is still in production in Russia and elsewhere. Ex-military examples of Makarov pistols are often prized by collectors of martial arms.

The Makarov is commonly described as a double-action firearm. But like most pistols that are so described, the Makarov may (at the option of the user) be fired either in double-action or single-action operation. In double action, a pull on the trigger both cocks and releases the hammer, to fire a cartridge that is already in the chamber. In single action, the hammer is separately cocked, either manually (by the user) or automatically (by movement of various mechanisms when the pistol is fired); a pull on the trigger then serves only to release the hammer. Typically, a "double-action" pistol is fired by double action for the first shot, and single action thereafter.

Makarov pistols may be considered to be essentially identical in all mechanical respects, regardless of the country or year of manufacture. Universally, the Makarov pistol has an exposed safety on its left side that can be manually engaged, but it does not incorporate a magazine safety. A magazine safety is a device that automatically renders the pistol incapable of being fired while the magazine is removed from a well in the pistol's frame. Of course, magazine safeties are not new. Proponents of magazine safeties have patented numerous examples over the past seventy years. Provided below is a listing of the significant patents known to the applicant.

| Patent | Inventor | Title |
|---|---|---|
| 1,024,932 | G. Vander Haeghen | Small Arm |
| 1,183,115 | E. G. Reising | Trigger Mechanism For Automatic Firearms |
| 2,563,720 | B. Guisasola | Magazine-Operated Safety For Automatic Firearms |
| 3,415,000 | J. Koucky et al. | Magazine Catch Means Including A Trigger Safety |
| 3,857,325 | F. S. Thomas | Semi-Automatic Firearm |
| 4,031,648 | F. S. Thomas | Magazine Safety and Ejector |
| 4,291,481 | R. L. Hillberg | Firearm Magazine Safety Mechanism |
| 4,420,899 | M. V. Bourlet | Automatic Pistol With Combined Magazine Control Safety And Magazine Ejection Mechanism |

-continued

| Patent | Inventor | Title |
|---|---|---|
| 4,428,138 | L. W. Seecamp | Double-Action Trigger Mechanism With Trigger-Blocking Magazine Safety For Firearms |
| 5,225,612 | K. Bernkrant | Magazine Gun Lock Safety |

So, numerous examples may be found in the patent literature of how to incorporate a magazine safety as an integral part of the kinematic chain between a pistol's trigger and its hammer, etc. The ability to incorporate a magazine safety into a new pistol, as it is being designed, can be described as essentially a matter of design choice. However, when a particular pistol has already been designed and built, it is a completely different matter to consider whether it might be possible to retrofit the pistol with such a safety. Initially, them is the problem of finding interior space to insert new or modified parts into an existing pistol; and there is also the matter of avoiding interference with moving parts that are involved in normal pistol operation. And even if the technical obstacles can be overcome, there remains the question of whether the modification requires such an expenditure in tooling and labor as to make the modification economically infeasible.

There are four patents that are known to the applicant that can be aptly categorized as involving modifications of existing pistols. All four of these patents relate to modifications of pistols that were manufactured by Colt's Patent Fire Arms Manufacturing Company of Hartford, Conn.; two relate to the COLT Cal. .45 Model 1911, and two relate to the COLT WOODSMAN. They are listed below.

| Patent | Inventor | Title |
|---|---|---|
| 1,638,068 | G. H. Tansley | Magazine Safety Device For Automatic Pistols |
| 1,719,384 | G. H. Tansley | Magazine Safety Device For Automatic Pistols |
| 2,372,519 | W. F. Roper | Magazine Safety For Automatic Firearms |
| 2,459,838 | J. Quinn et al. | Trigger Lock For Pistols |

But even these four patents reveal that some original part (or parts) must be modified by being drilled, machined or otherwise altered in order to accommodate the "add-on" magazine safeties that have been disclosed. And when considering the retrofitting of an existing pistol with a magazine safety, the economic feasibility of doing so will likely be determined by the costs of tooling and skilled labor for: 1) disassembly; 2) drilling holes, machining slots or making whatever structural changes are needed (in parts that may already have been hardened and that would therefore be difficult to cut); 3) cleaning; and 4) reassembly.

While the technical features of magazine safeties have been known for many years, the desirability of such devices remains open to debate; indeed, the firearms community of manufacturers and their customers are divided about equally as to whether such devices are desirable. Thus, the inclusion of a magazine safety in any particular firearm is essentially a matter of the preference of the designer or user.

As further background for this invention, an important consideration to collectors of military memorabilia (including firearms) is that an item be, or at least appear to be, in the same condition as it was when originally manufactured. At a minimum, a collectible firearm should look like it is in the same condition as when it was originally issued to military personnel. So, if it should become necessary to drill new holes, machine grooves or slots, or add new appendages in order to accommodate a new magazine safety, then such machine work will almost certainly reduce the appeal of the modified pistol to serious collectors of authentic memorabilia. Thus, if a person should ever choose to add a magazine safety to a Makarov pistol, it would be desirable to incorporate such a device without any alteration of the original parts.

It would also be desirable to incorporate a magazine safety in a Makarov pistol without any change in the external appearance of the pistol, thus preserving the authenticity (and thereby the value) of ex-military examples for collectors of martial arms.

It is a further object of this invention to permit a magazine safety to be installed and then later removed from a Makarov pistol without leaving any evidence of its earlier installation, fully restoring the pistol to its original configuration—if a collector so desires.

One more object is to provide a magazine safety for a Makarov pistol that can be installed without requiring any major disassembly of an existing pistol (as contrasted with a pistol that is being newly manufactured and assembled).

It is also an object of this invention to provide a magazine safety that can be economically retrofitted by—the simple installation of two small parts, one of which is a spring.

These and other objects will be apparent from a careful reading of the specification and the concluding claims, and the drawings that are provided herewith.

BRIEF DESCRIPTION OF THE SEVERAL FIGURES OF THE DRAWINGS

Figure 7:
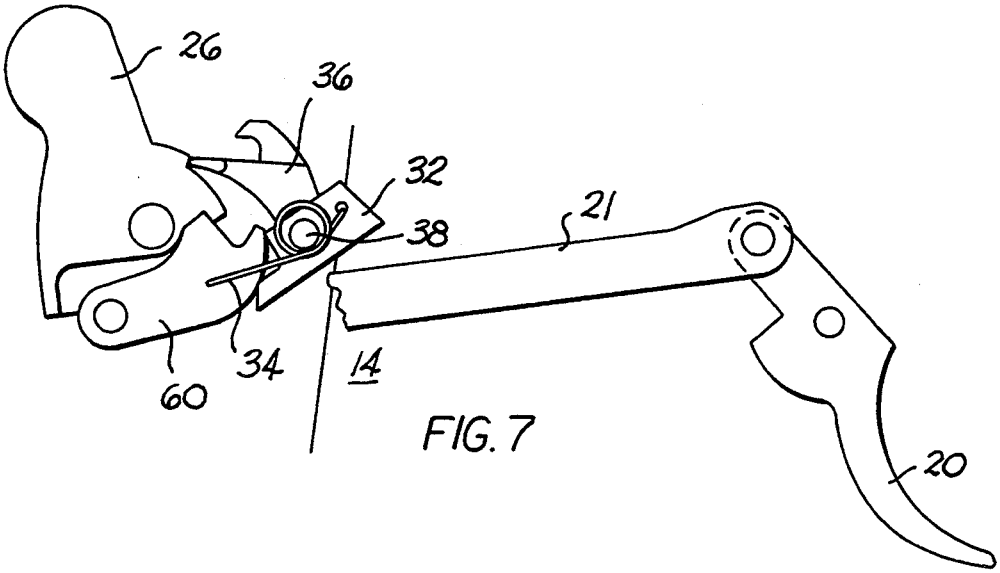
FIG. 7 is a side elevational view of the several pans that make up the kinematic chain between the trigger and the hammer, with the trigger being shown at essentially its "rest" position, and showing the safety device installed and protruding into the magazine well.
Figure 8:
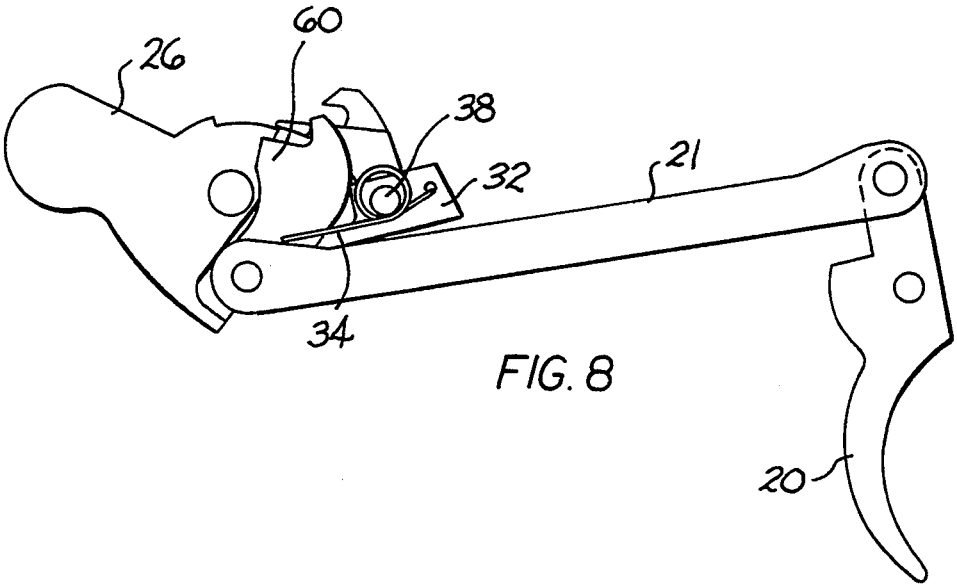
Figure 9:
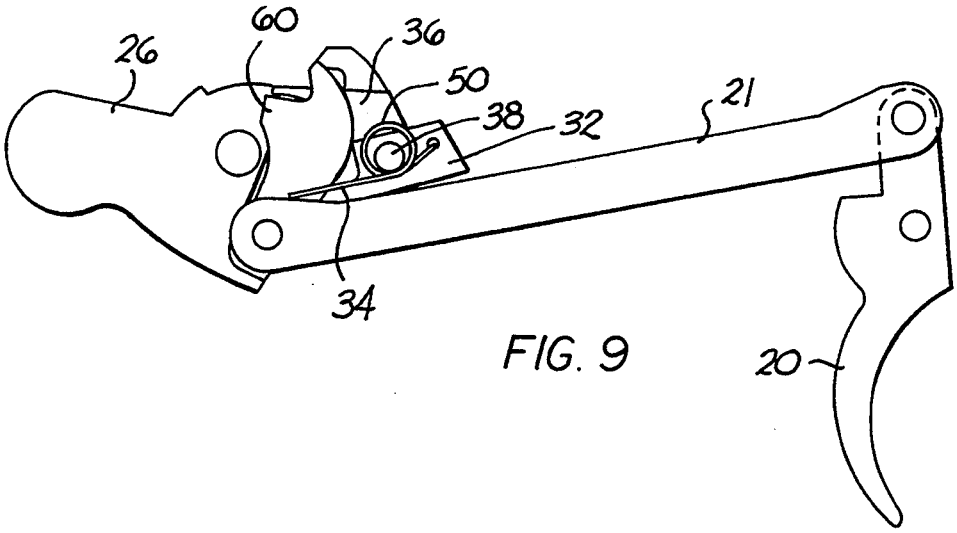

FIG. 8 is a side elevational view similar to FIG. 7, showing the trigger pulled as far as it will go in attempted double-action operation with the safety device installed, and showing how the new safety plate makes contact with the sear cam and prevents the sear cam from being rotated sufficiently as to allow the hammer to be disengaged; and FIG. 9 is a side elevational view similar to FIG. 8, showing the hammer cocked (in the pistol's single-action mode), and showing the trigger pulled as far as it will go when the magazine has been removed, and showing how the new safety plate makes contact with the sear cam and prevents it from lifting the sear to a hammer-release position.

BRIEF DESCRIPTION OF THE INVENTION

The invention comprises an auxiliary safety device that is intended for use with a semi-automatic Makarov pistol, said pistol constituting the major sidearm of the USSR beginning about 1954. The major pans of a Makarov pistol include a frame (or body), a barrel that is rigidly attached to the frame, and a well in the frame for receiving a magazine. The magazine is designed to hold as many as eight rimless, straight—case cartridges that are commonly referred to as 9×18 millimeter (abbreviated as "mm") Makarov cartridges. Other significant parts include a trigger, a trigger bar, a hammer, a manual safety, a sear that is pivotable about a transverse axis, a sear cam that is rotatably mounted at one end of the trigger bar and which operates on the sear and hammer, and a post that defines the axis about which the sear pivots during normal operation of the pistol. The auxiliary safety device that constitutes this invention operates completely independently of the pistol's original (manual) safety, and its sole function is to preclude firing of the pistol when the magazine has been removed from the pistol's well.

The auxiliary safety device comprises two elements: 1) a relatively thin structural plate with a circular opening so that the plate can be rotatably mounted on the sear post, and 2) a tempered spring that biases the structural plate toward a first position at all times. The first position is one in which a portion of the structural plate extends into the magazine's well for a distance that is sufficient to encroach into the space that is normally occupied by an installed magazine. The presence of a magazine in the pistol's well causes the plate to be pivoted backward (by an angle of about 50°) about an axis through its circular opening—to its second position, in spite of the urging of a torsion spring that biases the plate toward its first position. A rear portion of the safety plate butts against the sear cam when the trigger is pulled but the plate is in its first position, thereby preventing the sear cam from fully rotating. This interferes with normal operation of the pistol, and the pistol cannot be fired when the magazine has been removed. The pistol operates normally when a magazine has been installed and the plate is rotated back to its second position.

It is considered to be significant that the auxiliary safety device can be selectively attachable to the pistol as an "aftermarket" device without requiring alteration of any of the pistol's original parts. Too, it is possible that the auxiliary safety device might someday be removed from the pistol by a gunsmith or other knowledgeable person without leaving any evidence that it was ever present. Hence, if an owner ever desired to restore a pistol to its "as-issued" military condition, this could be done.

DETAILED DESCRIPTION OF A PREFERRED EMBODIMENT OF THE INVENTION

Figure 1:
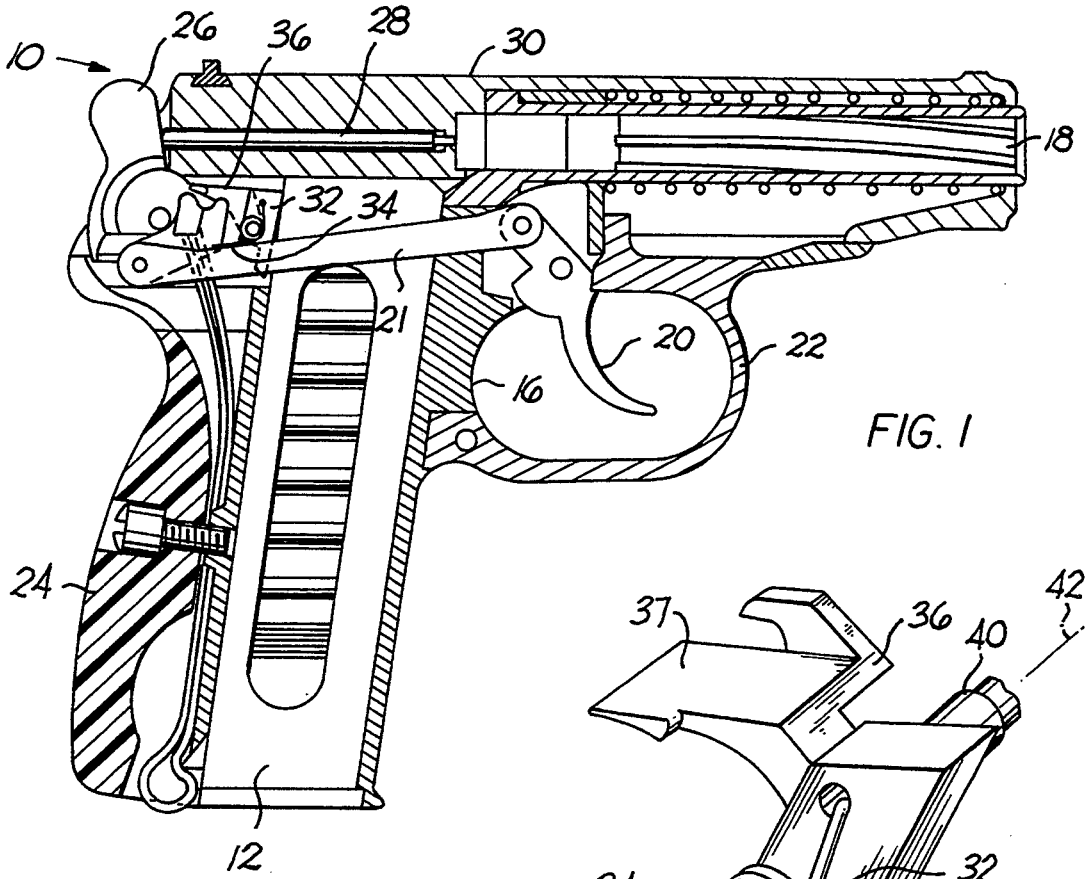
FIG. 1 is a cross-sectioned, side elevational view of a Makarov pistol, the sectional plane passing vertically and longitudinally through the pistol, and showing a magazine installed in the pistol—as well as many of the pistol's internal parts at a "rest" position.

Referring initially to FIG. 1, a side elevational view of a Makarov pistol 10 is shown in cross section, showing a magazine 12 installed in the pistol's well. As stated earlier, the Makarov pistol is a semi-automatic pistol that is magazine-fed, blowback-operated, and categorized as a double-action pistol. That is, pulling the trigger will initially cause the sear cam to retract the hammer—and then release it, so that the hammer will fall on the rear end of the firing pin; with a round in the chamber, the pistol will fire. Those skilled in the art will recognize that the pistol includes a frame 16, a barrel 18, a trigger 20, a trigger bar 21, a trigger guard 22, a grip 24, an exposed hammer 26, a firing pin 28, and a slide 30.

Also shown in FIG. 1 is a new safety device whose operation is based upon the presence (or absence) of the magazine in the gun's well. The safety device consists of only two parts, a relatively thin structural plate 32 and a spring 34. The purpose of the spring 34 is to bias the plate 32 forwardly, so that the plate will project into the space that is normally occupied by the magazine—if the magazine is removed. In this particular embodiment (in which the plate 32 is designed to rotate), it will rotate clockwise (in this fight-side view)into the magazine well, in response to urging by the spring 34. When the magazine is not in the pistol, the tension in the spring 34 is partially relaxed by virtue of the clockwise rotation that is permitted. The movement of the plate 32 between its first and second positions, and the effect of such movement on operation of the pistol, will be readily visible in subsequent views.

Figure 2:
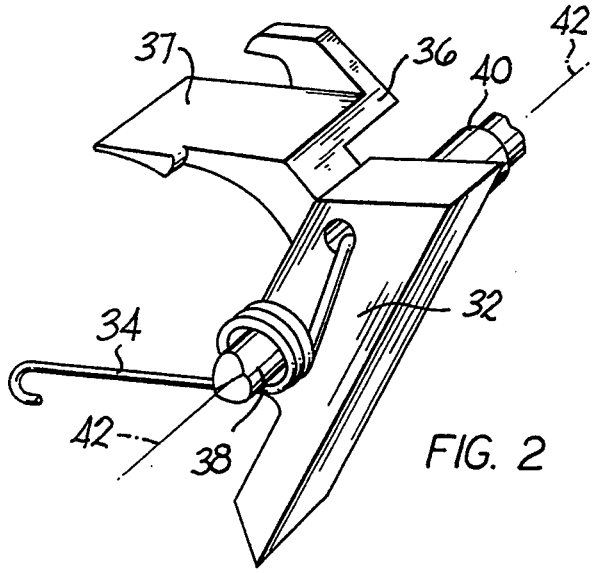
FIG. 2 is a perspective view of the two parts that constitute the invention, namely, a relatively thin plate and a spring, said parts being mounted on the pistol's sear.
Figure 4:
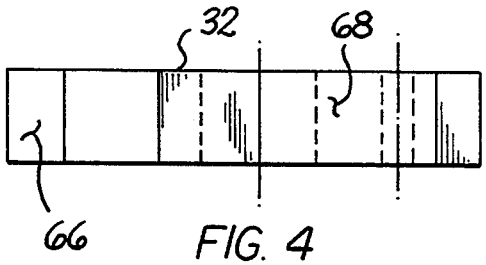
FIG. 4 is a top plan view of the plate shown in FIG. 3.

To better appreciate the shape and size of the new safety device, attention will now be mined to FIG. 2, which is a perspective view of the safety device and the sear, at a scale that causes the elements to be shown much larger. As stated in the well-known *Firearms Encyclopedia* authored by George C. Nonte, Jr., a sear is that part of a firearm that engages the hammer and holds it in the cocked position until firing is desired; and this is the sense in which the term sear is used in this description. The sear 36 has a rearwardly extending ledge 37 that bears against a notch in the hammer 26 and holds it in the cocked position for single-action operation. When the trigger 20 is pulled and the trigger bar 21 moves to the right, a sear cam 60 (shown in FIG. 7) rotates and moves upward, forcing the sear 36 out of the notch and releasing the hammer 26 to fall and strike the firing pin 28.

In double-action operation of a Makarov pistol, the sear 36 has no active role, but it must be lifted out of the way of the hammer 26. The hammer is being cocked and held rearwardly only by engagement with a projection on the back of the sear cam 60. When the hammer 26 is almost fully cocked, the sear cam 60 will have rotated far enough to become disengaged from the hammer, and the hammer will fall and strike the firing pin 28.

It should be appreciated, therefore, that it is rotation of the sear cam 60 that releases the hammer 26 in both double-action and single-action operation. However, in double-action operation the sear cam 60 releases the hammer directly—by disengaging from the hammer just short of the hammer's full cocking stroke. In single-action operation, the sear cam 60 releases the hammer indirectly—by acting on the sear 36. It is believed to be important to note that the hammer 26 has an earlier release point in double-action than in single-action operation. So, to prevent the pistol from firing when the magazine has been removed, the new safety plate 32 must be able to halt rotation of the sear cam 60 in both of the positions that are shown in FIGS. 8 and 9.

The sear 36 also has a fight pivot post 38 and a left pivot post 40, with both stub-like posts being aligned along a pivot axis 42. The combination of the right and left pivot posts 38, 40 function in the same way that a single transverse pin would function—in supporting the sear 36 for pivotal movement with respect to the frame 16. By combining the two short pivot posts 38, 40 as a unitary part of the Makarov sear 36, there is no risk of losing a critical pin during disassembly of the pistol 10. But it is conceivable that a person might someday choose to replace the unitary sear and its two stubby pivot posts with separate elements, and then assemble those separate elements in the gun. Whether the sear 36 is manufactured as one piece with two stubby "axles" (as originally designed by Makarov) or as multiple pieces will not affect the function of the safety device disclosed herein, because the sear will obviously have to pivot with respect to the frame—about axis 42—if the hammer is to be released. For simplicity in referring to the two stub posts 38, 40—in combination, they may sometimes be referred to in the manner in which they function, i.e., essentially as a single "post" or axle that extends transversely from one side of the frame to the other side and about which the sear 36 pivots.

Figure 3:
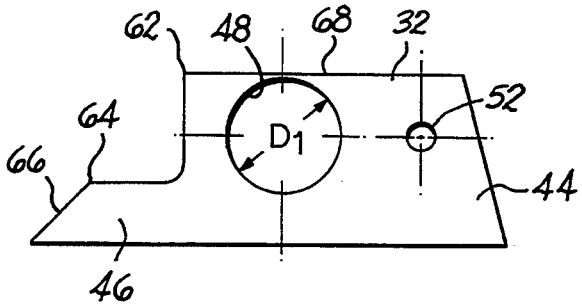
FIG. 3 is a side elevational view of the plate shown in FIG. 2.

Shown mounted on the fight post 38 is the relatively thin structural plate 32. The plate 32 has a from portion 44 and a rear portion 445, said portions being separated in this preferred embodiment by a relatively large and circular opening 48 (FIG. 3) of sufficient diameter to provide at least a slip fit with the post 38. At a minimum, the clearance between the post 38 and the opening 48 must be such as to foster easy rotation of the plate 32 with respect to the post. A nominal diameter $D_1$ for the opening 48 is about 4.1 mm.

Figure 6:
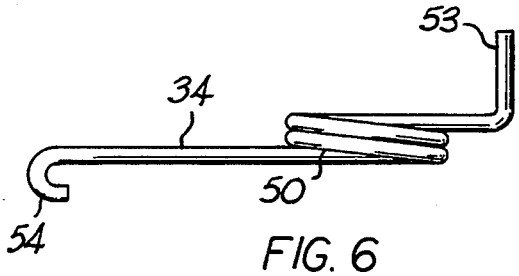
FIG. 6 is a top plan view of the spring shown in FIG. 5.
Figure 5:
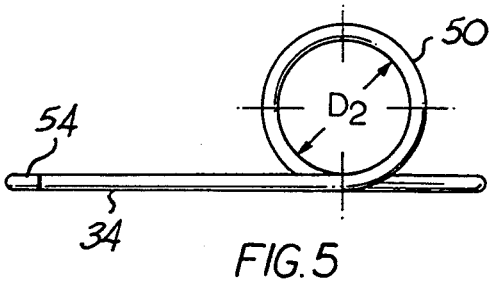
FIG. 5 is a side elevational view of the spring shown in FIG. 2.

Also clearly shown in FIG. 2 is the aforementioned torsion spring 34, illustrated as a wire spring with a central loop 50 that is loosely mounted on the post 38. A nominal diameter for the music wire from which the preferred spring is formed is about 0.50 mm, and a nominal diameter $D_2$ for loop 50 is about 4.3 mm. To render the two elements 32, 34 effective, there must be some way of connecting them. The preferred manner is to provide a relatively small transverse hole 52 in the plate 32, and to bend to the left the forward end of the spring 34, forming an L-shaped "hook" 53 that can be inserted into this hole. Such a "hook" 53 is shown in FIG. 6. The rear end of the spring 34 may be bent to the right, forming a U-shaped end 54 that can be made to lie on top of the pistol's trigger bar—to provide the equivalent of an "anchor" for the spring's rear end. When the shaped end 54 bears against the trigger bar 21, torque may be applied to the spring 34 by temporarily bending it counterclockwise before its front end 53 is inserted into hole 52. (The spring's "rest" condition is shown in FIG. 5.) Of course, the memory of the deformed spring 34 will act to try to straighten out the spring; and this will have the effect of continuously urging the pivotal plate 32 in a clockwise direction. Perhaps it should be mentioned that the spring 34 is important, but its strength is not what a person might normally describe as critical, because all of the loads that are involved in the "safety" function of the device are transmitted by the structural plate 32. Thus, the spring 34 serves only a purpose of continuously biasing the plate 32 to a forward position, and the spring is never involved in any direct kinematic linkage between the trigger and the hammer.

Referring next to FIG. 7, the rearmost portion of the Makarov trigger bar 21 has been broken away in order to reveal how the new plate 32 rotates clockwise to put its rear portion next to the sear cam 60 when the pistol's magazine has been removed from the magazine's well 14. The sear cam 60 is pivotally mounted to the rear end of the trigger bar 21, and normally moves forward and up when the trigger 20 is pulled, causing the hammer 26 to be rotated backwardly and the sear 36 to move up. When the mechanism is "at rest" and the safety plate is rotated forwardly, the front face of the sear cam 60 will be opposite, and can be made to bear against, the plate 32 at two locations that are designated as 62, 64 in FIG. 3. If an effort should be made to fire the pistol by double-action operation after the magazine is removed, the trigger will begin to move backward, and the trigger bar 21 will move forwardly. The sear cam 60 rotates upwardly and counter-clockwise —until the from face of the sear cam makes contact with surface 66 and/or regions 62, 64 on plate 32; the sear cam 60 will then be blocked against further rotation, and the hammer 26 will be precluded from rotating backward to its release point.

It might be noted that plate 32 need not have any kind of a complex radius on the rear surface in order to effectively bear against the sear cam 60. Rather, the contact surfaces can be essentially flat or linear; such a design promotes simplicity in manufacturing the plate 32. These two contact regions 62, 66 (and their underlying support structure) have the strength to hold the sear cam 60 against movement when the trigger is pulled, because the plate 32 is preferably made of high strength steel, e.g., stainless steel or the like. A preferred material for the plate is 4140 high carbon steel that has been heat-treated to a Rockwell "C" hardness of at least 32 (commonly abbreviated as Rc 32). It is also advantageous that the contact regions 62, 66 lie very close to a straight line between axis 42 and the pivotal connection between the trigger bar 21 and the sear cam 60. And if a force diagram were to be drawn for the parts that are involved in this safety apparatus, it would be readily appreciated that the compactness of the apparatus contributes significantly to its efficacy.

If an effort should be made to fire the pistol by single-action operation (after the magazine has been removed), the rear portion of plate 32 will bear against the sear cam 60 and block it from full movement (forward and upward) as the trigger is pulled. This will prevent the sear cam 60 from moving far enough to raise the sear 36 and release the already cocked hammer 26. This condition is shown in FIG. 9. Thus, the auxiliary safety device disclosed herein is effective to preclude firing of the pistol when the magazine has been removed, whether the pistol is being operated in a double-action mode or a single-action mode.

It will perhaps be instructive to point out that the structural part of the safety device (i.e., plate 32) is rather small, having a nominal length of about 16 mm and a height of about 6 mm; its preferred thickness will be about 3 mm. One reason for this small size is that there is not much spare room in the standard Makarov pistol for anything that was not part of the original design. Indeed, it is believed to be significant just to have discovered that enough room can be found in a Makarov pistol to squeeze in a magazine safety without interfering with normal pistol operation. And after it was learned that a magazine safety might be possible, it became important to establish dimensions and tolerances that would be compatible with a wide variety of existing parts whose dimensions were already fixed.

Referring once again to FIG. 3, the opening 48 in plate 32 is shown as a complete aperture whose periphery encompasses 360°. But it will be noted that the thin top portion of the plate 32, i.e., the portion that extends over the opening 48 from the front portion 44 to the rear portion 46 (and which may be aptly called a "bridge") need not necessarily be continuous. As illustrated in this figure, if the top surface of the plate 32 should be lowered to provide even more clearance for resetting the sear cam 60 after firing, this would mean that the center of opening 48 will be even closer to top surface 68. Indeed, it is even conceivable that the opening 48 could "break out" into the top surface 68, such that the peripheral surface of the opening may diminish to, for example, 330°. However, such an occurrence will not be a problem, because there is still sufficient material in the rest of the plate 32 to offer adequate resistance against any force that may be manually applied through the trigger and trigger bar 21. So a full 360° opening for aperture 48 is preferred but not mandatory.

Installation of the structural plate 32 and its associated spring 34 is accomplished by initially field stripping the pistol 10; this is done in a conventional manner by pulling the slide 30 to the rear, tilting it up and then removing it. Removing the slide exposes the sear 36, the slide stop, and the slide stop spring. Those persons knowledgeable about Makarov pistols will know that the slide stop spring is then unhooked from the slide stop; this allows the slide stop to be rotated upwardly—where it can be used as a lever to help lift the right end of the sear post 38 a short distance away from a hole in the right side of the frame 16. After the sear 36 has been slightly rotated, it may then be lifted upward from the frame 16 in a well known manner. While the sear 36 is separated from the frame, the plate's central opening 48 and a central loop 50 in the spring 34 are slipped over the exposed end of the sear post 38. For emphasis, it will be mentioned again that no alteration of the sear 36 is necessary in order to install the plate 32; nor is there a need for an exotic tool or particularly skillful labor. Furthermore, the combined weight of the two new parts (plate 32 and spring 34) is only about 20 grains, which is so little as to be essentially negligible in comparison with the nominal 1.6 pounds that an empty pistol weighs. It can be accurately said, then, that the addition of the auxiliary safety device increases the total weight of a Makarov pistol by significantly less than 1%.

Once the structural plate 32 is in place (with respect to the sear 36), the sear is simply manipulated as necessary and moved downwardly until it reaches an engaged position with the pistol's frame, thereby capturing the plate and its associated spring. The structural plate 32 is then rotated as necessary to orient it correctly with respect to the sear cam 60 (as in FIG. 7), and then the front of the spring 34 is connected to hole 52 in the plate. Spring end 54 is then lifted into position on top of trigger bar 21. Of course, the spring 34 is shaped so that when it is installed on the sear post 38 and connected to the plate 32, it will continuously bias the plate to its first position. A working moment arm is established by the distance between the center of the sear pivot post and the aperture 52, and its value is about 4.5 mm. A suitable torsion spring has a spring constant of about 45 Newtons/millimeter$^2$. The plate 32 will remain in its first position until a magazine has been inserted into the pistol's well, causing the plate to be rotated backward Coy an angle of about 50°) to its second position. Backward movement of the most-forward comer of the plate 32, in a direction that is parallel to the pistol's barrel, will typically be about 3 mm.

It is believed worthy of mention that no interrelation has been described between the pistol's original "manual" safety and the auxiliary safety device that has been disclosed herein. This is deemed to be significant, because it is believed to be useful for the owner of a Makarov pistol to be able to selectively install and remove an auxiliary safety device without affecting the factory-original safety in any way.

After a person has been instructed on how to field ship the Makarov pistol, etc., and assuming that the person has nimble fingers, it is reasonable to expect that the structural plate and its associated spring could be installed in about three or four minutes. Of course, even this short period of installation time that is associated with the new safety could almost be negated if the safety device were to be installed as an item of original equipment on a new pistol. A new pistol that is being assembled in a factory with a magazine safety would take only a negligible amount of extra time to put together. While only a preferred embodiment of the invention has been disclosed herein in great detail, it should be apparent to those skilled in the art that modifications and variations on the disclosed structure could be made without departing from the spirit of the invention. That is, a spring 34 of tempered piano wire has been disclosed as the preferred manner of keeping the safety plate 32 biased toward the pistol's magazine well. But it is conceivable that a specially shaped safety plate might accommodate an alternative design (utilizing, for example, a leaf spring) for biasing the plate forwardly. Too, an alternative safety plate might be made to involve at least some translation (rather than solely rotation) as it moves from a "blocking" to a "non-blocking" position. Also, a great deal of attention has been focused herein on retrofitting existing Makarov pistols. But it should be kept in mind that the invention can also be used to incorporate a magazine safety into Makarov pistols that are currently being manufactured. Hence, the specific embodiment disclosed herein should not be considered to be limiting; and the scope of the invention should be deemed to be measured only by the claims that are appended hereto.

What is claimed is:

1. An auxiliary safety device intended for use with a semi-automatic pistol of the Makarov design, and said pistol constituting a blowback-operated, magazine-fed pistol that is operable in a double-action mode and a single-action mode, said pistol having a front and a rear and factory-original pans that include a frame, a barrel, a magazine, a well in said frame for receiving the magazine, a trigger, a trigger bar, a hammer, a manually actuated safety, a sear that pivots about a certain axis, a cam that operates on the sear and the hammer, and a transverse post having an axis about which the sear pivots during normal operation of the pistol, and said auxiliary safety device being automatically operable to preclude firing of the pistol when the magazine has been removed from the pistol's well, comprising:

a. a relatively thin structural plate having front and rear portions and having first and second normal positions, the plate's first position being characterized by having a frontal portion of the plate extending into the magazine's well for a distance that is sufficient to encroach into the space that is normally occupied by an installed magazine, and the presence of a magazine in the pistol's well causing the plate to be moved backward to its second position in spite of the urging of a spring that biases the plate toward its first position, and the rear portion of said plate interfering with normal operation of the pistol when the plate is in its first position and the trigger is pulled, such that the pistol cannot be fired when the magazine has been removed and the plate has been biased to its first position; and b. a spring mounted on one of the pistol's factory-original parts for continuously biasing the plate to its first position.

2. The auxiliary safety device as claimed in claim 1 wherein the thickness of the relatively thin structural plate is about 3 millimeters, such that said plate will fit in a space between the pistol's trigger bar and the sear without requiring any alteration of a factory-original pistol, whereby said auxiliary safety device may be selectively attachable to the pistol as an aftermarket device without requiring the alteration of any of the pistol's original parts.

3. The auxiliary safety device as claimed in claim 1 wherein the spring has two ends and is mounted on the transverse post that defines the axis about which the sear pivots, and the spring being so shaped that when it is installed on the post that one end will bear directly against the relatively thin structural plate.

4. The auxiliary safety device as claimed in claim 1 wherein the relatively thin structural plate has a relatively large and generally circular opening located about midway between its front and rear portions, said generally circular opening being large enough to fit around and rotate with respect to the transverse post that defines the axis about which the sear pivots, and the movement of the relatively thin structural plate between its first and second positions being a rotative movement about said transverse post.

5. The auxiliary safety device as claimed in claim 4 wherein the relatively large and generally circular opening is bounded by plate material for a full 360 degrees, such that the large opening may be aptly referred to as an aperture in the relatively thin plate.

6. The auxiliary safety device as claimed in claim 1 wherein the spring has two ends, and further including means for mechanically engaging one end of the spring with the relatively thin structural plate, while at the same time a second end of the spring bears against a part of the pistol's original operating mechanism.

7. The auxiliary safety device as claimed in claim 6 wherein the means for mechanically engaging one end of the spring with the relatively thin structural plate includes a relatively small aperture that is located in the front portion of the plate, and one end of the spring having a hook that is sized and shaped to pass through the second aperture and be held therein.

8. An auxiliary safety device intended for use with a semi-automatic pistol of the Makarov design, said pistol constituting a blowback-operated, magazine-fed pistol that is operable in both double-action and single-action modes, said pistol having a front and a rear and having factory-original parts that include a frame, a magazine, a well in said frame for receiving the magazine, a trigger, a trigger bar, a hammer, a manually actuated safety, a sear, a cam that operates on the sear and the hammer, and a post about which the sear pivots during normal operation of the pistol, and said auxiliary safety device being operable to preclude firing of the pistol when the magazine has been removed from the pistol's well, and said auxiliary safety device being selectively attachable to the pistol as an aftermarket device without requiring the alteration of any of the pistol's original pans, and said auxiliary safety device operating independently of the factory-original safety, comprising:

a. a structural plate having a generally central aperture that is relatively large and sized to engage the post about which the sear pivots with sufficient clearance as to foster easy rotation about said post, and the generally central aperture essentially dividing the plate into from and rear portions, and the plate also having a second and relatively small aperture that is located in the front portion, said second aperture being sized to permit engagement with one end of a torsion spring, and said plate having first and second normal positions, said first position being one in which the from portion of the plate extends into the magazine's well for a distance that is sufficient to encroach into the space that is normally occupied by an installed magazine, and the presence of a magazine in the pistol's well causing the plate to be pivoted backward about its central aperture to its second position, and the backward pivoting of the plate being in opposition to the urging of a torsion spring that biases the plate toward its first position, and the rear portion of the plate interfering with normal movement of the sear cam when the plate is in its first position, and the pistol being operable in a normal manner when the plate is in its second position; and b. a torsion spring formed from wire and having first and second ends and a generally circular coil located between the first and second ends, and the spring's first end having a hook that engages the second aperture in the plate, and the spring having a length so that its second end will rest on a rearward portion of the pistol's trigger bar, and the generally circular wire coil having a diameter that is slightly larger than that of the post about which the sear pivots, such that the torsion spring may be mounted on the sear pivot post, and an installed spring being so shaped as to continuously bias the plate to its first position.

9. The auxiliary safety device as claimed in claim 8 wherein the torsion spring has a working moment arm that is established by the distance between the center of the sear post and the second aperture, and wherein said working moment arm is about 4.5 millimeter, and the torsion spring has a spring constant of about 45 Newtons/millimeter$^2$.

10. The auxiliary safety device as claimed in claim 8 wherein the structural plate has a length of about 16 millimeters, a height of about 6 millimeters, and a thickness of about 3 millimeters.

11. The auxiliary safety device as claimed in claim 8 wherein the pistol weighs about 1.6 pounds when it is empty, and the combination of the plate and the torsion spring weigh so little that the total weight of the pistol is increased by significantly less than 1% when the auxiliary safety device has been installed.

12. The auxiliary safety device as claimed in claim 8 wherein the structural plate is made of steel that has a hardness of at least Rc 32.

13. The method of providing an auxiliary safety device for a semi-automatic pistol of the Makarov design, said pistol constituting a blowback-operated, magazine-fed pistol that is operable in a double-action or a single-action mode, said pistol having factory-original parts that include a frame, a slide, a magazine, a well in said frame for receiving the magazine, a trigger, a trigger bar, a hammer, a manual safety, a sear for acting on the hammer, a sear cam for acting on the sear and the hammer, and a post about which the sear pivots during normal operation of the pistol, the auxiliary safety device serving to preclude firing of the pistol when the magazine has been removed from the pistol's well, comprising the steps of:

a. providing a structural plate that has a relatively large and generally central aperture that is sized to slip over and rotate with respect to the post about which the sear pivots, and the generally central aperture essentially dividing the plate into front and rear portions, and the plate also having a second and relatively small aperture that is located in the front portion, said second aperture being sized to permit engagement with one end of a torsion spring, and said plate having first and second normal positions, the first position being one in which a portion of the plate extends into the magazine's well for a distance that is sufficient to encroach into the space that is normally occupied by an installed magazine, and the presence of a magazine in the pistol's well causing the plate to be pivoted backward about its central aperture to its second position in spite of the urging of a torsion spring that biases the plate toward its first position, and the rear portion of the plate interfering with normal operation of the sear cam when the plate is in its first position by preventing the sear cam from moving far enough to allow the hammer to be released when the pistol's trigger is pulled; and b. providing a torsion spring formed from wire and having first and second ends, and the torsion spring having a generally circular wire coil located between the first and second ends, and the spring's first end having a hook that engages the second aperture in the plate, and the spring having a length so that its second end will rest on a rearward portion of the pistol's trigger bar, and the generally circular wire coil having a diameter that is larger than that of the post about which the sear pivots, such that the torsion spring may be mounted on the post about which the sear pivots, and the spring being so shaped that when it is installed it continuously biases the structural plate to its first position, whereby the pistol cannot be fired in either its single-action or its double-action mode when the magazine has been removed and the structural plate has been biased to a position in which it protrudes into the magazine well.

14. The method as claimed in claim 13 wherein said structural plate and said torsion spring are sized to fit over the factory-original post about which sear pivots without requiring any alteration of said post, and including the step of attaching said structural plate and torsion spring to the pistol by slipping the structural plate and the torsion spring over an exposed end of the post about which the sear pivots, whereby the auxiliary safety device may be marketed as an aftermarket device without requiring the alteration of any of the pistol's original parts.

15. The method as claimed in claim 13 wherein the structural plate and the torsion spring are selectively added to and then removed from the pistol, and the step of removing the structural plate and the torsion spring being effective to return the pistol to its factory-original condition without leaving any evidence that the structural plate and torsion spring were ever installed.

16. The method as claimed in claim 13 wherein the structural plate and the torsion spring are selectively installed and removed from the pistol at the will of the pistol's owner, and said installation and removal are accomplished without the use of any tools.

17. The method as claimed in claim 16 wherein the structural plate and the torsion spring are installed on the pistol following the act of field-stripping the pistol by removing the slide, and the step of removing the slide serving to expose the sear such that it may be temporarily removed from the pistol in order to install the structural plate and the torsion spring.

* * * * *